United States Patent [19]

Beneke

[11] 4,270,246

[45] Jun. 2, 1981

[54] CARDING FLAT ARRANGEMENT

[75] Inventor: Wolfgang Beneke, Monchen-Gladbach, Fed. Rep. of Germany

[73] Assignee: Trutzschler GmbH & Co. KG, Monchen-Gladbach, Fed. Rep. of Germany

[21] Appl. No.: 943,217

[22] Filed: Sep. 18, 1978

[30] Foreign Application Priority Data

Sep. 21, 1977 [DE] Fed. Rep. of Germany ..... 2742420

[51] Int. Cl.[3] ..... D01G 15/24

[52] U.S. Cl. ..... 19/113

[58] Field of Search ..... 19/112–114, 19/102, 103, 111, 129 R

[56] References Cited

U.S. PATENT DOCUMENTS

| | | | |
|---|---|---|---|
| 335,760 | 2/1886 | Leigh | 19/102 |
| 2,097,254 | 10/1937 | Platt | 19/113 |
| 3,439,386 | 4/1969 | Spisak | 19/129 R |
| 3,651,542 | 3/1972 | Mann et al. | 19/129 R |
| 3,793,677 | 2/1974 | Bechtel, Jr. | 19/113 |

FOREIGN PATENT DOCUMENTS

| | | | |
|---|---|---|---|
| 2604465 | 8/1976 | Fed. Rep. of Germany | 19/113 |
| 522686 | 4/1955 | Italy | 19/113 |
| 666185 | 2/1952 | United Kingdom | 19/113 |
| 682980 | 11/1952 | United Kingdom | 19/113 |
| 921450 | 3/1963 | United Kingdom | 19/113 |

*Primary Examiner*—Louis Rimrodt

*Attorney, Agent, or Firm*—Haseltine and Lake

[57] ABSTRACT

A carding flat arrangement for cards in which lateral end head sections are guided along sliding guide members. The center section is made of a material of low specific gravity, and the end head section can be pressed against the sliding guide. The end head sections, furthermore, are provided with sliding surfaces of wear-resistant material of substantially high specific gravity. The center section may be made of aluminum, and be in the form of a hollow section. Reinforced fiberglass may also be used for the center section, and stabilizing elements may be inserted therein. The end head sections may be connected to the stabilizing elements, and the sliding surfaces of the end head sections may be coated with a friction-reducing material. A pressure element is applied to press against the rear side of the carding flat arrangement and/or against the end head sections.

1 Claim, 3 Drawing Figures

CARDING FLAT ARRANGEMENT

BACKGROUND OF THE INVENTION

The present invention relates to a carding flat arrangement which consists of a center section and lateral end head sections guided along sliding guides.

There is already known in the art a carding flat arrangement which consists of a T-shaped bar made of cast iron or a light material, for example, aluminum. The carding flat arrangement of this type, made of cast iron, has the disadvantage that it bends considerably under its own weight. The frequently rough surface is the reason for flying fibers etc., falling from the carding flat arrangement back into the drum region. In addition, the large weight is a heavy load for the driving unit and makes handling difficult. The use of light metals has proven unsuitable because the carding flat arrangement of light metal has not the weight necessary to have the carding flat arrangement lie safely on the sliding guides of the card.

It is, therefore, an object of the present invention to provide a carding flat arrangement of the above species which avoids the disadvantages mentioned, and which constitutes a small load for the driving unit.

Another object of the present invention is to provide a carding flat arrangement of the foregoing character, in which lies safely on the sliding guides.

A further object of the present invention is to provide a carding flat arrangement, as described, which is substantially simple in construction and may be economically fabricated. It is also an object of the present invention that the carding flat arrangement have a substantially long service life.

SUMMARY OF THE INVENTION

The objects of the present invention are achieved by making the center section of a material of low specific gravity so that the driving unit receives only a small load when using approximately 100 cover bars. This center section is combined with two end head sections which are made to press against the sliding guides so that the cover bar lies safely on the sliding guides. Furthermore, the combination in accordance with the present invention prevents excessive sagging.

The end head sections are expediently provided with sliding surfaces of wear-resistant material of high specific gravity or as a whole, they are made of a wear-resistant material of high specific gravity so that the overall weight of the cover bar is increased. The center section is preferably made of aluminum, for example, an aluminum casting. Particularly expedient is a center section with a hollow profile which can be simple, produced by extrusion pressing, and permits easy production by sawing to the desired length.

According to another advantageous embodiment, fiberglass-reinforced synthetic material is used for the center section, with stabilizing elements worked into it. A particularly rigid construction can be achieved by having the end head sections connected to the stabilizing elements. The sliding surfaces of the end head sections are entirely or partially coated with a low-friction material, for example, Teflon which has a friction coefficient of 0.05 to 0.04. In this manner, the end head sections can be achieved by having the end head sections connected positively, that is, running in the sliding guides. According to a particularly expedient embodiment, the end head sections can be made to press against the sliding guides by having a pressing element, for example, a spring element or sturdy flexible belt press against the rear side of the carding flat arrangement and/or against the end head sections.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
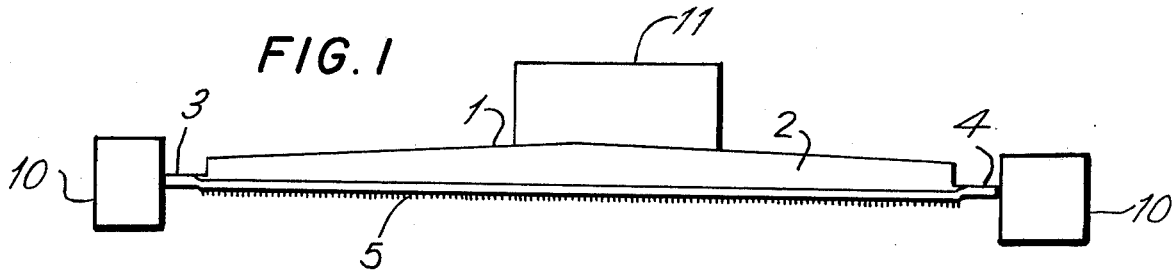
FIG. 1 shows a view of the carding flat arrangement in accordance with the present invention.

FIG. 1 shows the carding flat arrangement in accordance with the present invention; it consists of a center section 2 and lateral end head sections 3, 4 guided by sliding guides 10. The center section is made of aluminum. The card clothing 5 is shown at its bottom side. The center section 2 terminates in end head sections 3 and 4 which are made of chrome-nickel steel (see FIG. 2).

Figure 2:
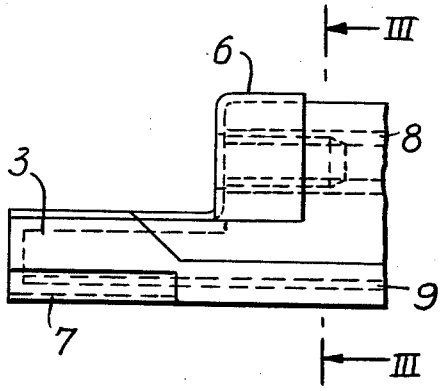
FIG. 2 shows a detail view of another embodiment.
Figure 3:
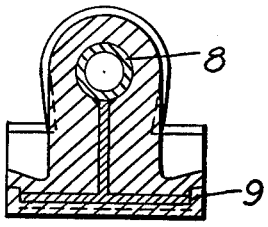
FIG. 3 shows a section taken along line III—III in FIG. 2.

FIG. 2 shows a carding flat arrangement made of fiberglass-reinforced synthetic material into which during manufacture a T-shaped section bar 3, 9 with a tube 8 has been pressed (see FIG. 3). Into the end of tube 8, a thread for the fastening screw of the carding flat arrangement chain has been placed. Via the end head section 3, a chrome-nickel steel sheet 6 has been pressed on; this steel sheet is rigidly connected to the tube 8. The ends of the carding flat arrangement are made of a sliding synthetic layer 7, possibly made of polyamide. A pressing element 11, for example, a spring element or flexible belt, may be used to press against the rear side of the carding flat and/or against the end head sections.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptions should and are intended to be comprehended within the meaning and range of equivalence of the following claims.

What is claimed is:

1. A carding flat arrangement comprising: lateral end head sections guided along sliding guide members; a center section of substantially low specific gravity material; said end head sections being pressable against said sliding guide members; said end head sections having sliding surfaces of wear-resistant material of substantially high specific gravity; T-shaped stabilizing elements inserted into said center section, said stabilizing elements being connected to said end head sections; said end head sections having sliding surfaces coated with a friction-reducing material; a tube attached to said T-shaped reinforcing element, an outside end of said tube being threaded for fastening screw of flats chain.

* * * * *